US005606897A

United States Patent [19]

Quinn

[11] Patent Number: 5,606,897

[45] Date of Patent: Mar. 4, 1997

[54] OIL FILTER WRENCH AND PACKAGING THEREFOR

[75] Inventor: Gregory F. Quinn, Fullerton, Calif.

[73] Assignee: FloTool International, Inc., Tustin, Calif.

[21] Appl. No.: 577,332

[22] Filed: Dec. 22, 1995

Related U.S. Application Data

[62] Division of Ser. No. 398,983, Mar. 6, 1995, Pat. No. 5,499,561.

[51] Int. Cl.[6] ..... B25B 13/00; B65D 75/02

[52] U.S. Cl. ..... 81/124.6; 81/121.1; 206/349; 206/376; 206/378

[58] Field of Search ..... 81/124.6, 121.1, 81/120, 124.3, 124.7, 64, 3.4, 3.09, 3.07; 206/349, 376, 377, 378, 461, 462, 207, 814, 815, 821, 822, 467, 469

[56] References Cited

U.S. PATENT DOCUMENTS

| | | | |
|---|---|---|---|
| 3,703,234 | 11/1972 | Howard | 206/349 |
| 3,904,034 | 9/1975 | Saunders | 206/378 |
| 4,165,805 | 8/1979 | Fethkie et al. | 206/349 |
| 4,899,877 | 2/1990 | Kiernan | 206/376 |
| 5,353,666 | 10/1994 | Rogers | 81/3.4 |
| 5,499,561 | 3/1996 | Quinn | 81/124.6 |

FOREIGN PATENT DOCUMENTS

| | | | |
|---|---|---|---|
| 559443 | 9/1993 | European Pat. Off. | 206/349 |
| 1124150 | 10/1956 | France | 206/462 |
| 1549480 | 12/1968 | France | 206/462 |
| 1267084 | 3/1972 | United Kingdom | 206/462 |

*Primary Examiner*—Willis Little
*Attorney, Agent, or Firm*—Harold L. Jackson

[57] ABSTRACT

A oil filter wrench and packaging arrangement therefore are disclosed. The oil filter wrench has a cup-shaped body with a socket formed therein for receiving the top of a conventional oil filter. The interior side wall has a step therein circumscribing the socket. The oil filter wrench can be packaged between a cardboard backing and plastic cover sheet such that the cover sheet over laps the rim of the cup-shaped body. The step spaces the plastic sheet from the socket, keeping the socket area open. With this packaging arrangement the consumer can try his oil filter with the wrench without destroying the package to determine whether the wrench suits his needs before purchasing it.

10 Claims, 2 Drawing Sheets

OIL FILTER WRENCH AND PACKAGING THEREFOR

BACKGROUND OF THE INVENTION

1. Related Application

This application is a division of application Ser. No. 08/398,983 filed Mar. 6, 1995, now U. S. Pat. No. 5,499,561 for OIL FILTER WRENCH AND PACKAGING THEREFOR.

2. Field of the Invention

The invention relates generally to oil filter replacement tools and more particularly to oil filter wrenches and oil filter wrench packaging arrangements.

3. Description of Related Art

Oil filter wrenches are used in routine oil filter changing operations to remove the oil filter from a vehicle after the oil is drained from a engine. While professional automobile maintenance and service shops provide oil change services for many automobiles, many individuals still prefer to change the, oil in their automobiles themselves as a part of the vehicles routine maintenance. Such routine engine oil changes, which typically take place every 3000 miles, are probably the most effective part of an engines preventative maintenance program to assure the longevity of the life of an engine.

Conventional automobile oil filters comprise a cylindrical metal container with filters inside for removing dirt, metallic particles and other debris from the oil which circulates through the engine. The cylindrical metal container has a closed dome-shaped end with a plurality of flats circumscribing the end portion of the container. Typical oil filter wrenches may be either the bail style having a handle with a hoop attached at the end of the handle; or a shallow metal cup style which has a plurality or flats that cooperate with the flats on the top portion of the oil filter during the filters removal. Oil filters and oil filter wrenches are sold in automotive supply stores which sell a variety of automobile tools, supplies, replacement parts and other items. Many of such items are sold in peg board fashion or point of purchase displays wherein the item to be sold is contained in a blister package and hung on hooks or metal hangers for the consumer to pick and choose directly himself. Such blister packaging arrangements include a sheet of plastic which is vacuum formed then heat sealed on to the cardboard backing with the wrench disposed therebetween.

Today there are about thirteen different sizes of oil filters requiring thirteen corresponding sizes of metal cup style oil filter wrenches. These oil filter wrenches as noted above are typically displayed in a store for the consumer to choose the correct oil filter wrench for his vehicles oil filter. In many cases, the consumer is unsure which oil filter wrench matches his oil filter. Instead of guessing and buying a wrench that he is unsure of that meets his needs, the consumer may open or otherwise destroy a selected wrench package in order to compare the wrench size against his filter. Otherwise, without testing the oil filter wrench before its purchase, the consumer may have to return to the store after going home and discovering he has purchased an inappropriate filter wrench. Opened filter wrench packages with their oil filter wrenches that are tried at the store and don't fit the consumer's particular oil filter are discarded, leaving the product open on a shelf or on the floor. The automotive store owner may end up with a number of opened packages in his store that must be dealt with, which is very inconvenient.

An oil filter wrench and oil filter packaging arrangement that mitigates or avoids the aforementioned disadvantages would be highly desirable and provide an advancement in the art.

SUMMARY OF THE INVENTION

It is therefore an object of the invention to provide an improved oil filter wrench that is easy and safe to use.

It is another object of the invention to provide an oil filter wrench of relatively simple unitary construction.

It is yet another object of the invention to provide an oil filter wrench packaging arrangement that allows a consumer to size the oil filter wrench with his particular oil filter prior to purchasing the oil filter wrench.

It is still a further object of the invention to provide an oil filter packaging arrangement that provides point of purchase display capability.

An oil filter wrench according to the present invention comprises a cup-shaped body having an annular inner surface with an inner step and a lower lateral wall portion with angled facets thereon forming a wrench socket that can receive the crowned top portion of a conventional oil filter. An oil filter wrench, such as for example the aforedescribed oil filter wrench, may be packaged in an oil filter packaging arrangement according to the present invention which comprises a base member and plastic sheet attached thereto with an oil filter wrench disposed therebetween. The plastic sheet overlaps the oil filter wrench outside its socket area. With this packaging arrangement, a conventional oil filter can be inserted into the oil filter wrench without the necessity of opening the packaging. Advantageously, the auto parts retailer will not be left with a number of opened packages from failed attempts of the consumer in trying to find the correct oil filter for his needs.

DESCRIPTION OF PREFERRED EMBODIMENTS

Figure 1:
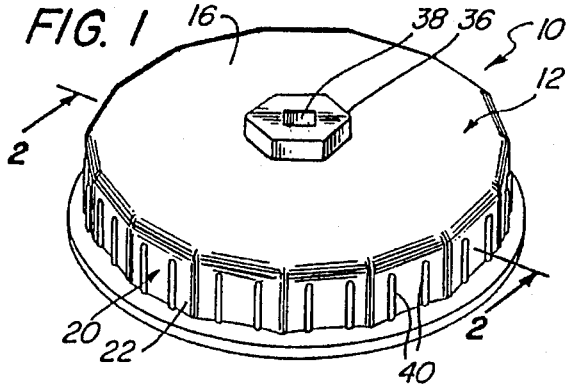
FIG. 1 is a perspective top view of the oil filter wrench of the present invention.
Figure 2:
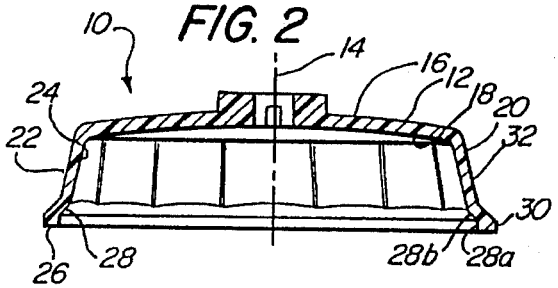
FIG. 2 is a cross-sectional side view of the oil filter wrench of taken along line 2—2 of FIG. 1.
Figure 3:
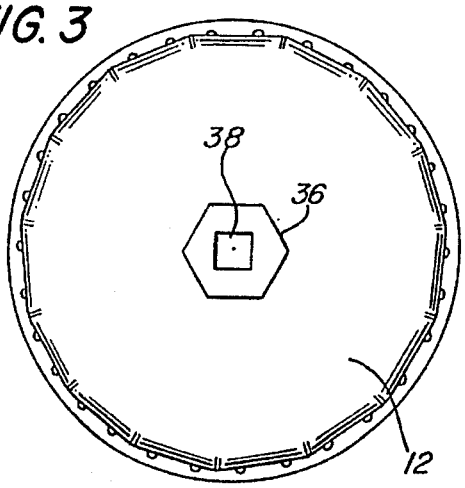
FIG. 3 is a top view of the oil filter wrench.
Figure 4:
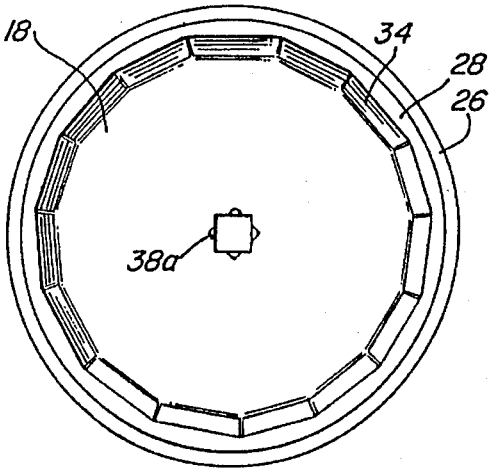
FIG. 4 is a bottom view of the oil filter wrench.
Figure 5:
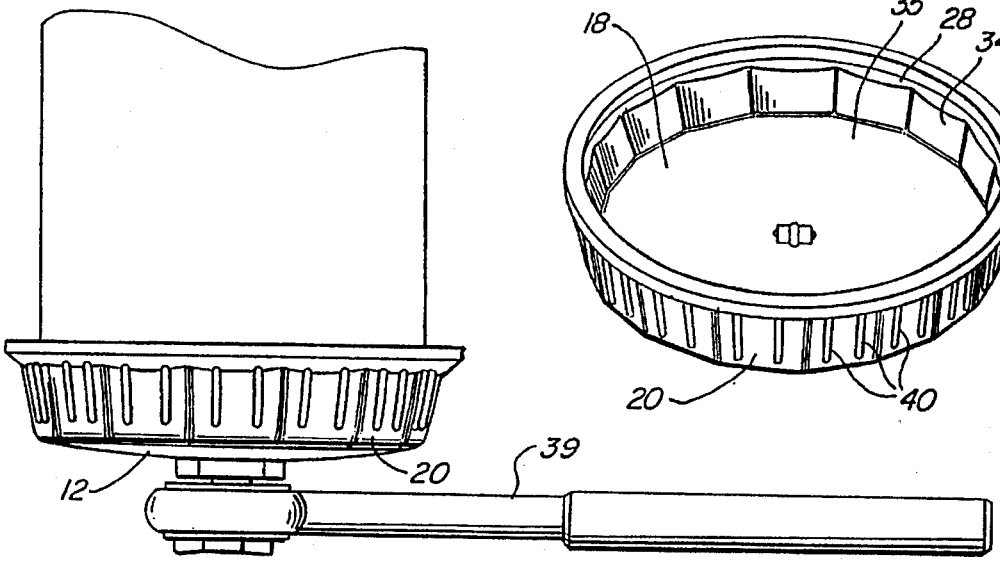
FIG. 5 is a side view of the oil filter wrench disposed over the end of a conventional oil filter with a conventional ratchet for turning the combination.
Figure 6:
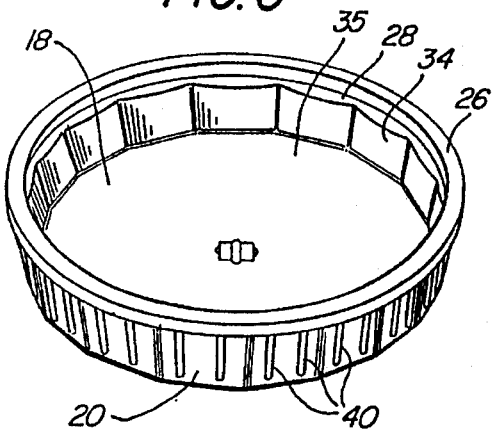
FIG. 6 is a perspective bottom view of the oil filter wrench.
Figure 7:
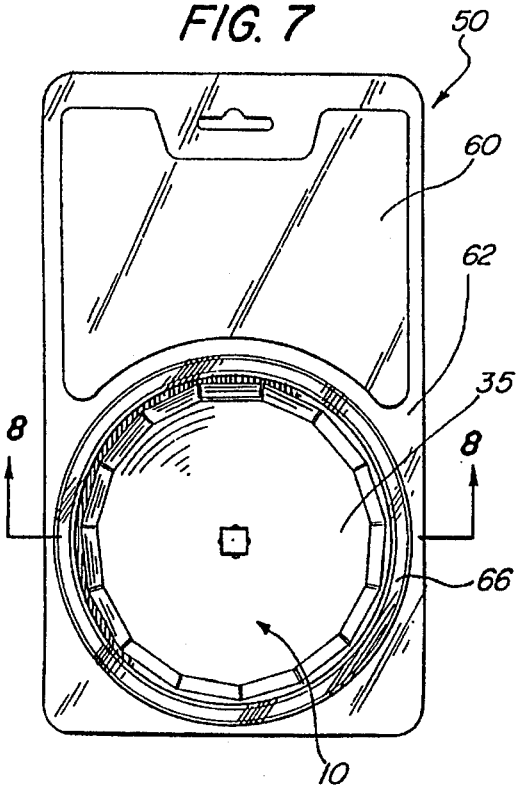
FIG. 7 is a top view of a packaging arrangement for an oil filter wrench.
Figure 9:
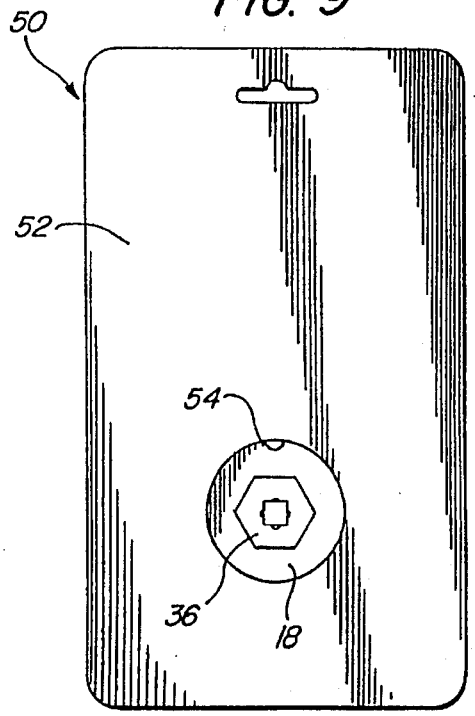
FIG. 9 is a bottom view of the oil filter packaging arrangement of FIG. 7.
Figure 8:
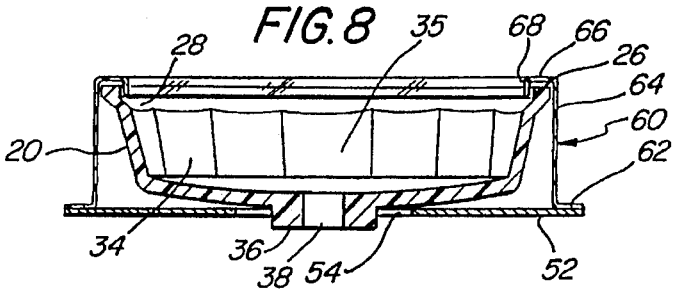
FIG. 8 is a cross-sectional side view of the oil filter wrench packaging arrangement taken along line 8—8 of FIG. 7.
Figure 10:
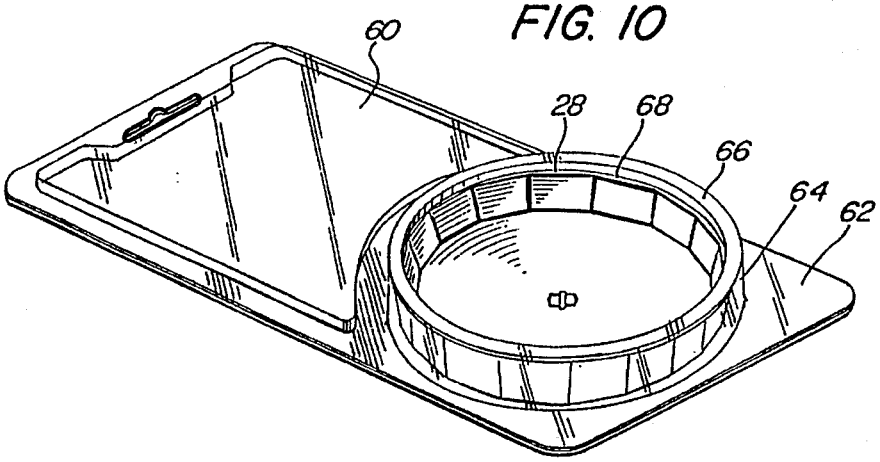
FIG. 10 is a perspective view of the oil filter packaging arrangement.

Referring now with more particularity to the drawings, wherein like or similar parts are designated by the same numerals throughout the various figures, FIGS. 1–10 illustrate a preferred embodiment of an oil filter wrench and oil filter wrench packaging arrangement. More particularly, oil filter wrench 10 illustrated in FIGS. 1–6 includes a dome-shaped top portion 12 that is dish shaped with a convex side 16 and concave side 18 and a longitudinal axis 14. A circumscribing annular wall 20 extends from the periphery of the dome-shaped portion 12 in the direction of the longitudinal axis 14. The annular wall 20 slopes at a slight angle from the side 16 as is illustrated in FIG. 2. The wall 20 has an outer surface 22 and an inner surface 24 that terminate together into a peripheral edge or rim 26. The inner surface 24 of the wall 20 has an integral step 28 a short distance down from the peripheral edge 26. The step 28 is formed by a vertically extending wall section 28*a* (parallel to the axis 14) and an inwardly inclined wall section 28*b* as is shown in FIG. 2. The step 28 forms an upper wall portion 30 which extends between the peripheral edge 26 and a lower inner wall portion 32 of the inner surface 24. While the upper inner wall portion 30 is shown as being smooth around the periphery thereof, the lower inner wall portion 32 has a plurality of angled facets or segments 34 forming a socket 35 for receiving the top of a conventional oil filter. More specifically, the angled facets 34 are arranged and sized to receive the top portion of a conventional oil filter which similarly has a plurality of angled facets or segments.

To aid the manipulation of the oil filter wrench 10, a nut 36 may be formed on the dome-shaped top portion 12 outer surface or the convex side 16 along the longitudinal axis 14. This nut 36 can be operated on by a tool such as an adjustable wrench (not shown) to break loose the oil filter from an automobile engine block. Additionally, the preferred oil filter wrench 10 may have a hole 38 through the nut 36 and dome-shaped top portion 12 along the longitudinal axis 14 for receiving a conventional ratchet wrench 39. More specifically for example, the hole 38 may be a ⅜ inch square hole socket opening with detents 38*a* for mating with the detent balls on a ⅜ inch drive socket wrench.

The outer surface 22 of the annular wall 20 has a plurality of longitudinally disposed ribs 40 which provide a means for an operator to grip the oil filter wrench by hand and thereby manipulate the oil filter once it is broken loose or to spin on the oil filter in the installation operation. This is especially useful when the filter or wrench may be slippery due to oil residue. While ribs are shown in this description of a preferred embodiment, other grasping arrangements are possible to aid in the hand manipulation of the oil filter wrench 10. The oil filter wrench 10 may be fabricated by a composite of nylon, graphite and fiberglass, for example. Such composites are poor conductors of heat and electricity and therefore provide some protection from such hazards when being used during an oil change.

A preferred packaging arrangement 50 for an oil filter wrench such as for example the oil filter wrench 10 described hereinabove, that allows the consumer (such as the home garage do it yourself mechanic) to match his particular oil filter to the desired oil filter wrench is illustrated in FIG. 7 through 10. Such packaging arrangement 50 includes a back member 52 which may be made of a flat sheet of cardboard material. For an oil filter wrench with a nut on the top such as shown with respect to oil filter wrench 10, the back member has a hole 54 therethrough for the nut to protrude through such that the top or convex side 16 of the oil filter wrench may sit directly on the back member 52 as shown with more particularity in FIG. 8 and 9.

A plastic sheet 60 is disposed on the back member 52 being affixed thereto by an adhesive such as glue or other suitable adhering means. The plastic sheet 60 and back member 52 form the basic components of the packaging arrangement 50 wherein an oil filter wrench is held therebetween. The plastic sheet 60 has a flat portion 62 which seats on the back member 52 and provides an area of the plastic sheet which is adhered to the base portion 52. Plastic sheet 60 has an upstanding cylindrical wall portion 64 which circumscribes the oil filter wrench 10. This wall portion 64 terminates slightly above the height of the oil filter into an over extending top wall portion 66 which in this embodiment is ring-shaped and extends over the rim or the end edge 26 of an oil filter wrench. The top wall portion 66 terminates into a downwardly extending wall portion 68 which goes into the oil filter wrench cavity a short distance. The wall portion 68 preferably extends parallel to the axis 14 and terminates above and adjacent to the demarcation between the wall sections 28*a* and 28*b* of step 28 in the oil filter wrench. In other words, the plastic sheet overlaps the rim or end edge of an oil filter wrench behind the wrench socket area 35 leaving this socket area open. The plastic sheet accordingly holds the oil filter wrench by its rim or end edge adjacent to the back member.

The oil filter wrench package 50 can conveniently be displayed in a point of purchase fashion in a retail automotive parts store or the like. Since the downwardly extending wall portion 68 of the plastic sheet 60 is disposed outwardly of the faceted inner wall portion 32 of the wrench 10, a customer can insert his particular oil filter directly into the oil filter wrench without removing the plastic sheet 50. Therefore, the consumer can easily determine whether he has found the oil filter wrench which correctly mates with his oil filter without disturbing or destroying the oil wrench package 50.

The above-described detailed description of a preferred embodiment describes the best mode contemplated by the inventors for carrying out the present invention at the time this application was filed and is offered by way of example and not by way of limitation. For example, the packaging arrangement can be employed with other devices having sockets or openings wherein the socket or opening may be tried before the product is purchased. Furthermore, for example, in certain applications it may be sufficient for the over extending wall portion to merely extend over the rim or outer edge of an oil filter or other packaged item outside the socket area, without the need for a downwardly extending wall portion. Accordingly, various modification may be made to the above-described preferred embodiment without departing from the scope of the invention and are deemed to lie within the spirit and scope of the invention as set forth in the following claims.

What is claimed is:

1. An oil filter wrench for an oil filter and packaging therefore which allows a filter to be inserted into the wrench for sizing purposes without removing the packaging comprising:

a wrench body having an annular wall with a peripheral edge, the annular wall having an inner surface with segmented facets thereon for receiving the top portion of an oil filter; and packaging comprising a back member and a front sheet affixed to the back member and extending over the peripheral edge of the wrench, whereby the wrench is securely held to the back member while providing unobstructed access to the segmented facets on the inner surface of the annular wall of the wrench by a filter for size comparison.

2. The invention of claim 1 wherein the wrench body further includes a top portion connected to the annular wall.

3. The invention of claim 2 wherein the annular wall has an outer surface with a plurality of ribs for aiding the grasping of the oil filter wrench by hand.

4. The invention of claim 3 wherein the top portion of the wrench body is formed with a nut formed thereon for receiving a conventional socket or open end wrench.

5. The invention of claim 1 wherein the front sheet extends downwardly over the rim of the annular wall.

6. An oil filter wrench for removing conventional oil filters of the type with segmented facets on the top portion thereof and packaging for the wrench which allows a filter to be inserted into the wrench for size comparison without the removal or destruction of the packaging, the combination comprising:

a wrench body having an annular side wall with a rim and an inner surface defining a socket for engaging the segmented facets on the top portion of a filter, the body including a top portion through which rotary motion may be imparted to the annular side wall;

a back member; and a plastic sheet affixed to the back member and extending over the rim of the wrench body to secure the wrench body to the back member while providing access to the socket on the inner surface of the annular wall for permitting a filter to be inserted into the socket for size comparison without requiring the removal or destruction of the plastic sheet.

7. The invention of claim 6 wherein the plastic sheet extends downwardly over the rim of the annular wall.

8. The invention of claim 7 wherein the annular wall has an outer surface with a plurality of ribs for aiding the grasping of the oil filter wrench by hand.

9. The invention of claim 7 wherein the top portion of the wrench body includes a nut formed thereon for receiving a conventional socket or open end wrench.

10. A combined oil filter wrench for removing or installing conventional type oil filters and a package for holding and displaying the wrench comprising:

a wrench body having a longitudinal axis and an axially extending annular wall defining a socket portion on an inner surface thereof for receiving the top portion of an oil filter, the annular wall terminating at one end in a peripheral edge; and a package comprising a planar back member and a front plastic sheet affixed to the back member and overlying at least the peripheral edge of the annular wall of the wrench body to securely hold the wrench body to the back member while providing unobstructed access to the socket portion of the wrench to allow the top portion of an oil filter to be inserted into the wrench socket for size comparison.

* * * * *

UNITED STATES PATENT AND TRADEMARK OFFICE

CERTIFICATE OF CORRECTION

PATENT NO. : 5,606,897

DATED : March 4, 1997

INVENTOR(S) : Quinn

It is certified that error appears in the above-indentified patent and that said Letters Patent is hereby corrected as shown below:

On the title page, insert --Notice as follows:

[*] Notice: The portion of the term of this patent subsequent to March 6, 2015 has been disclaimed.--

Signed and Sealed this

Second Day of June, 1998

*Attest:*

*Attesting Officer*

BRUCE LEHMAN

*Commissioner of Patents and Trademarks*